US005443399A

United States Patent [19]

Jing et al.

[11] Patent Number: 5,443,399

[45] Date of Patent: Aug. 22, 1995

[54] ELECTRIC LIGHT BULB SOCKET POSITIONER FOR LAMP ASSEMBLIES

[76] Inventors: Wang S. Jing, 8-2, Pei Di Fen; Tai S. Yea, 2F, No. 2, Lane 86, Hsin Kuang Street, both of Chupei, Hsinchu, Taiwan

[21] Appl. No.: 189,763

[22] Filed: Feb. 1, 1994

[51] Int. Cl.[6] ..... H01R 17/00

[52] U.S. Cl. ..... 439/619; 439/675; 439/699.2

[58] Field of Search ..... 439/611–619, 439/602, 699, 356, 645, 375, 675, 668

[56] References Cited

U.S. PATENT DOCUMENTS

| | | | |
|---|---|---|---|
| 2,984,813 | 5/1961 | Bossi | 439/619 |
| 3,104,924 | 9/1963 | Capel | 439/619 |
| 4,999,751 | 3/1991 | Chen | 439/356 |
| 5,137,465 | 8/1992 | Chwang | 439/356 |
| 5,278,741 | 1/1994 | Ehrman | 439/356 |

*Primary Examiner*—Larry I. Schwartz
*Assistant Examiner*—Hien D. Vu
*Attorney, Agent, or Firm*—Morton J. Rosenberg; David I. Klein

[57] ABSTRACT

An electric light bulb socket positioner for lamp assemblies is provided. The lamp assembly consists of an electric light bulb sleeve, an electric light bulb stem and an electric light bulb. The light bulb stem, at the lower end of the electric light bulb socket, is provided with a pair of keyway slots formed through opposing wall portions. The slotted openings allow greater dimensional variability in the mating light bulb sleeve.

1 Claim, 5 Drawing Sheets

ELECTRIC LIGHT BULB SOCKET POSITIONER FOR LAMP ASSEMBLIES

BACKGROUND OF THE INVENTION

1. Field of the Invention

The invention is directed to the structure of an electric light bulb socket positioner for lamp assemblies. In particular, this invention directs itself to a positioner having a pair of opposed slotted openings to allow compressive displacement of portions of the positioner's wall.

2. Prior Art

The electric light bulb stem and electric light bulb sleeve of a conventional product, shown in FIG. 1, when assembled together, are subject to the following situations:

1. An electric light bulb socket 21 having an excessive outer diameter at the lower end of the electric light bulb stem 20 cannot be inserted into the sleeve 10 when the electric light bulb assembly is attempted; or, 2. An electric light bulb socket 21 having a diminutive outer diameter often falls out after assembly with the sleeve 10.

The foregoing two situations occur because the outer diameter of the conical electric light bulb socket at the lower end of the electric light bulb stem, is of a different dimension than that of the inner diameter of the sleeve. As a result, the outer diameter of a conventional electric light bulb socket is required to be of high precision.

SUMMARY OF THE INVENTION

The main design improvement of the instant invention consists of providing long keyway slots on two opposing positions of the outer wall of a conical electric light bulb socket, thereby enabling, responsive to the outer walls of the electric light bulb socket being subjected to insertion pressure, the aforementioned electric light bulb socket to provide a larger compressive flexibility to accommodate electric light bulb sleeves of different dimensions.

DESCRIPTION OF THE PREFERRED EMBODIMENT

Figure 1:
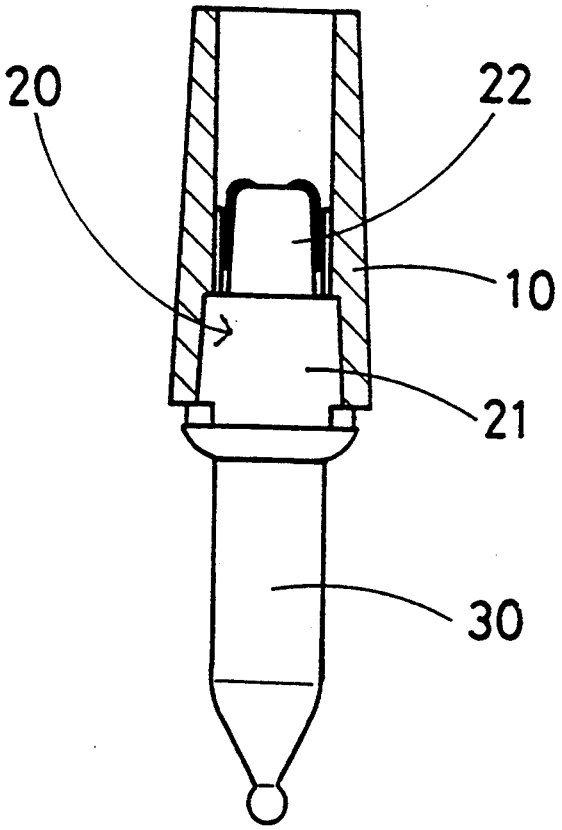
FIG. 1 PRIOR ART
FIG. 1 is a cross-sectional drawing of a conventional product.
Figure 2:
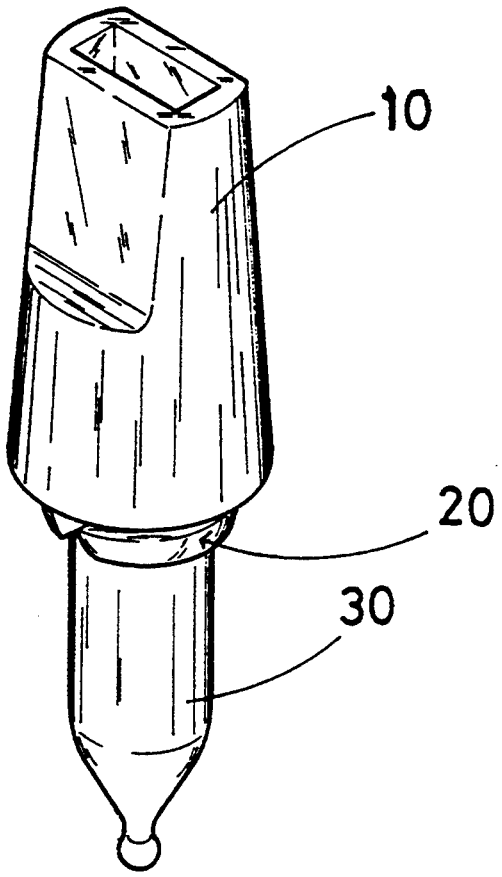
FIG. 2 is an isometric drawing of the preferred embodiment of the present invention.
Figure 3:
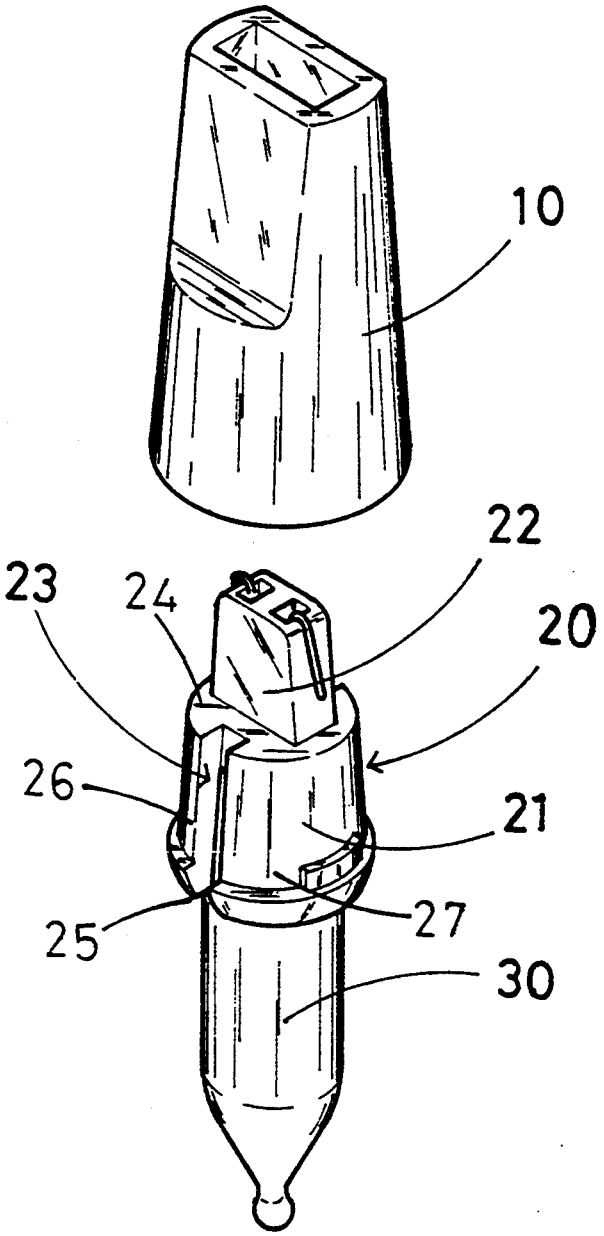
FIG. 3 is an exploded view of the preferred embodiment of the present invention.

As indicated in FIG. 2, the lamp assembly consists of an electric light bulb sleeve 10, an electric light bulb stem 20 and an electric light bulb 30. With regard to the aforementioned components, the electric light bulb sleeve 10 and electric light bulb socket 21 at the lower end of the electric light bulb stem 20, as shown in FIG. 3, are each conical (i.e., narrow at the top and wide at the bottom) in shape. The base 22 of the electric light bulb stem 20 is secured by insertion through the upper end of the electric light bulb socket 21, and the electric light bulb 30 is secured by insertion into the lower end of the electric light bulb socket 21.

Figure 4:
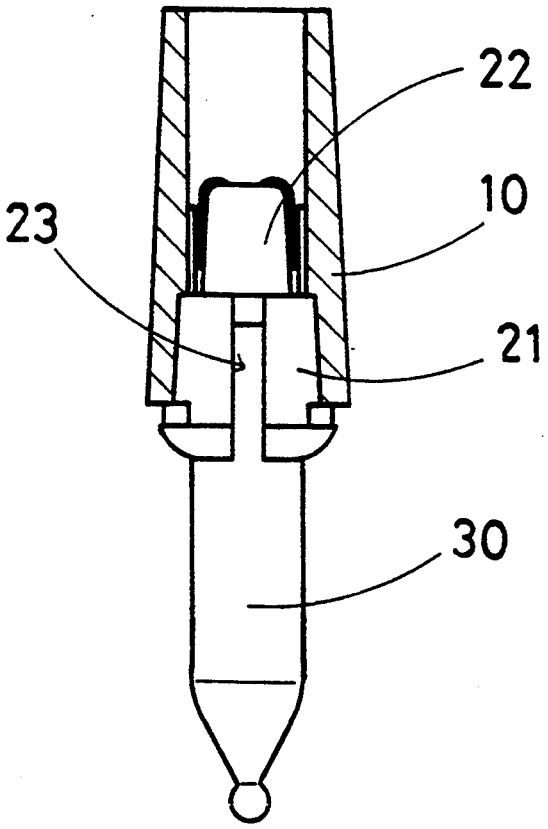
FIG. 4 is a cross-sectional drawing of FIG. 2.
Figure 5:
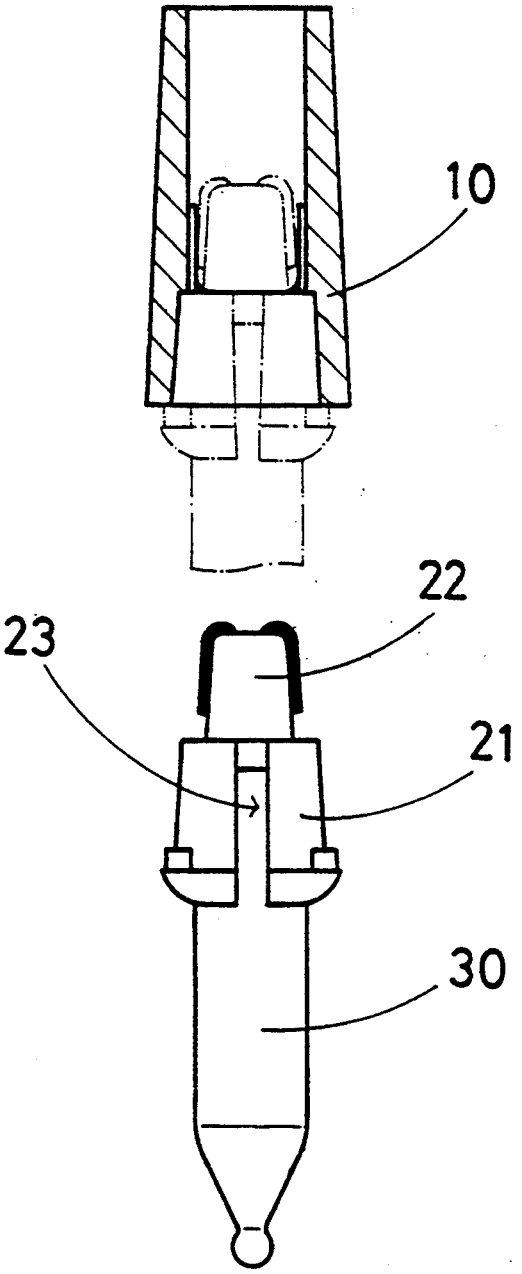
FIG. 5 is a cross-sectional drawing of FIG. 3.

As indicated in FIGS. 3, 4, and 5, the unique advantage of the system disclosed herein is the placement of two slots 23 on opposing sides of the outer walls of the electric light bulb socket 21, such that when the outer diameter of the electric light bulb socket 21 and the inner diameter of electric light bulb sleeve 10 are assembled together the walls are compressively displaced. Since there are slots 23 provided through the wall of socket 21 extending from the bottom wall 24 to the open end 23, this enables the outer walls 26, 27 to have a larger degree of compressive flexibility to accommodate electric light bulb sleeves 10 of varying internal diameters and maintain a tight assembly. Therefore, the outer diameter of the electric light bulb socket 21 need not be the subject of high precision dimensional requirements, as is required of conventional products. The electric light bulb socket 21 can thus be formed with larger dimensions and, furthermore, the larger compressive flexibility design of the socket accommodates assembly with the electric light bulb sleeve 10 which would otherwise be too tight, thereby reducing production costs.

Based on the foregoing description, the instant invention provides improvements which overcome the disadvantages of prior art assemblies, while also reducing the production costs associated with prior art requirements for parts made with a high degree of precision.

What is claimed is:

1. An electric light bulb socket assembly, comprising:

a longitudinally extended sleeve member having a through passage formed longitudinally therein, said through passage extending to an opening formed at one end of said sleeve member, said opening having an inner diameter dimension, said through passage being defined by an inner wall surface having a conical contour;

a light bulb having a at least a portion of one end thereof adapted for insert into said through passage of said sleeve member through said opening formed in said sleeve member; and, a socket member disposed within said through passage intermediate said light bulb portion and said inner wall surface of said sleeve member, said socket member being defined by a longitudinally extended tubular wall extending from a bottom wall thereof to an open end of said socket member, said tubular wall having an outer surface conical contour for contiguous interface with said inner wall surface of said sleeve member through passage, said open end of said socket member having an outer diameter dimension, said outer diameter dimension being greater than said inner diameter dimension, said tubular wall having a pair of opposing slotted through openings extending from said bottom wall to said open end to define a pair of tubular wall portions, said tubular wall portions being displaceable to reduce said outer diameter dimension to accommodate insertion of said socket member into said through passage of said sleeve member and said contiguous interface therebetween.

* * * * *